US007802418B2

(12) United States Patent
Vega

(10) Patent No.: US 7,802,418 B2
(45) Date of Patent: Sep. 28, 2010

(54) METHOD FOR PRODUCTION OF A YARN BY THE ASSEMBLY OF SEVERAL BASIC YARNS SUBJECTED TO A PRIOR TRANSFORMATION AND DEVICE FOR CARRYING OUT THE SAME

(75) Inventor: Christophe Vega, Alixan (FR)

(73) Assignee: Rieter Textile Machinery France, Valence, Cedex (FR)

( * ) Notice: Subject to any disclaimer, the term of this patent is extended or adjusted under 35 U.S.C. 154(b) by 621 days.

(21) Appl. No.: 11/568,043

(22) PCT Filed: Mar. 18, 2005

(86) PCT No.: PCT/FR2005/050173

§ 371 (c)(1),
(2), (4) Date: Oct. 18, 2007

(87) PCT Pub. No.: WO2005/105639

PCT Pub. Date: Nov. 10, 2005

(65) Prior Publication Data

US 2008/0098707 A1 May 1, 2008

(30) Foreign Application Priority Data

Apr. 23, 2004 (FR) ..... 04 50776

(51) Int. Cl.
*D01H 1/00* (2006.01)

(52) U.S. Cl. ..... 57/58.54; 57/58.55

(58) Field of Classification Search ..... 57/290, 57/58.52, 58.54, 58.55, 314
See application file for complete search history.

(56) References Cited

U.S. PATENT DOCUMENTS

| | | | | |
|---|---|---|---|---|
| 3,441,231 | A | 4/1969 | Siegel | |
| 3,884,025 | A * | 5/1975 | Oberender et al. | 57/293 |
| 4,100,721 | A * | 7/1978 | Seiichi et al. | 57/294 |
| 4,200,212 | A | 4/1980 | Hartig et al. | |
| 4,246,750 | A * | 1/1981 | Norris et al. | 57/293 |
| 4,943,009 | A * | 7/1990 | Gerstner-Stevens et al. | 242/472.8 |
| 5,772,136 | A * | 6/1998 | Gilbos et al. | 242/472.8 |
| 5,791,135 | A * | 8/1998 | Greenberg | 57/290 |
| 6,014,854 | A | 1/2000 | Greenberg | |

FOREIGN PATENT DOCUMENTS

EP 0 780 333 A1 6/1997

* cited by examiner

*Primary Examiner*—Shaun R Hurley
(74) *Attorney, Agent, or Firm*—Heslin Rothenberg Farley & Mesiti P.C.; Victor A. Cardona

(57) ABSTRACT

A method and apparatus for production of a yarn, by plying, twisting or covering several basic yarns, subjected to a prior transformation, is provided. At least one of the basic yarns is different from the others and/or is subjected to a different prior transformation. The prior transformation may be carried out in parallel in the same machine, by independent transformation members able to be independently controlled. A slackening of yarn tension resulting from the prior transformation to give the desired tension at an assembly point is carried out on yarn feeding devices. Routing of the yarns is achieved by guide members towards the point of assembly, where the staple yarns are combined and arranged in parallel. A bobbin receives the assembled yarns in a device, constituting or associated with a positive feed device operating without slippage with relation to the yarn. The yarn bobbin with assembled yarns is then placed on a spindle of a twisting machine for a second double plying, twisting, or covering process.

20 Claims, 10 Drawing Sheets

METHOD FOR PRODUCTION OF A YARN BY THE ASSEMBLY OF SEVERAL BASIC YARNS SUBJECTED TO A PRIOR TRANSFORMATION AND DEVICE FOR CARRYING OUT THE SAME

CROSS REFERENCE TO RELATED APPLICATIONS

This is a Section 371 filing of international application No. PCT/FR2005/050173 filed on Mar. 18, 2005, and published, in French, as International Publication No. WO 2005/105639 A1 on Nov. 10, 2005, and claims priority of French Application No. 0450776 filed on Apr. 23, 2004, which applications are hereby incorporated by reference, in their entirety.

BACKGROUND ART

The invention relates to the technical field of textile yarn processing machines.

In particular, the invention relates to machines like those comprising a plurality of working positions, particularly arranged in juxtaposition. Each of them has various means suitable for transforming the yarn in one or a plurality of steps, followed by its rewinding or spooling.

As examples, mention can be made of yarn processing machines which combine, on the one hand, means for advancing the yarns and, on the other, means for treating the yarns. The yarn advance means may consist of cylinders cooperating with press rollers, capstans, thread guides or other. The yarn treatment means may be based on a rotation, conferring on the yarns, for example, a twist on themselves or a winding of the yarns on one another.

The principle of this transformation is known, based on the one hand, on a rotation and conferring a torsion of the yarns on themselves or a winding of the yarns around one another, governed by the ratio of the speed of rotation of the spindle to the speed of travel of the yarn and, on the other, on the control of the yarn tension. A method called "single twisting" can be recalled here, which confers on the yarn a torsion on itself per turn of the spindle, while a "two-for-one twisting" method confers on the yarn two-torsions on itself per turn of the spindle.

In many cases, the transformation method also calls for treating several yarns in parallel, and assembling these yarns for subsequent transformation or spooling. Hence this implies an assembly of several transformed yarns on neighboring positions before sending them together to other transformation means and/or before rewinding them together.

According to the invention, it has appeared important to be able to control this assembly.

In known treatment machines, like those defined previously, they may comprise several members designed to advance the yarns, some of them being provided with non-slip driving means, and others, equipped with means optionally allowing slippage. The relative speeds of these members serve to control the tensions in the yarns, to create stretchings, to obtain stress relief or tension slackening. Only the drive speed, without slippage, of the members, serves to guarantee the speed of travel of the yarn and consequently the uniformity of the twisting.

During the assembly of a plurality of yarns, this means that for the assembled yarns to be of perfectly controlled length (for example, identical lengths), it is necessary:

- to have at least one common non-slip yarn advance member or perfectly synchronized members;

- for the yarns to reach this member with a perfectly controlled tension (for example, equal tensions) from one yarn to the next.

In yarn cabling or twisting machines, it is perfectly known to a person skilled in the art to provide a drive device designed to lower the yarn tension, for example, in the form of a capstan or a grid type delivery unit, generally known by the name of pre-delivery unit or pre-feeding unit. In the rest of the specification, the member is referred to as the "first feeding means". In general, this member permits slippage of the yarn and rotates in overspeed with respect to the yarn travel.

The yarn is then fed to a second "feeding" member, generally without slippage, ensuring control of the yarn travel speed. Very often, this second feed is provided by the rewinding system itself.

This ensures that the tensile force resulting from the yarn tension in the upstream processes is essentially absorbed by the first feeding means.

Reference can be made to FIG. 1, which shows, as an indicative and nonlimiting example, a yarn treatment machine having members suitable for producing an assembly of a plurality of yarns, according to the prior art.

This figure shows that the first feeding and yarn travel means (2*a*, 2*b*, 2*c*, 2*d*) are aligned together and rotated by a common shaft, by means of a drive member (8). The same applies to the feeding and spooling means (3*a*, 3*b*, 3*c*, 3*d*), which are aligned together and rotated by a common shaft by means of a drive member (5).

These arrangements serve to obtain a perfect synchronism between the positions. However, this configuration leads to tension variations at the outlet of the first feeding means, low in absolute value, but significant in relative value. These tension variations result from the upstream tension dispersions between the positions, added to which are the variations in friction coefficient, geometric tolerances of the components of the feeding system itself. For example, for an upstream tension of between 10 and 12 N, the outlet conditions may vary from one position to another from 0.3 N to 0.6 N.

While such variations do not have any significant impact on the spooling quality when the yarn is spooled individually, the same cannot be said for an assembly of yarns required to meet an equi-length requirement.

In fact, during an assembly, such relative tension variations at the outlet of the first feeding means are incompatible with the requirements to control the length of the assembled yarns, if the assembly is made at this location.

To attempt to solve this problem, according to the prior art, the assembly is prepared upstream of the first feeding member, with the understanding that at this location, even if the absolute dispersion is wider, the relative dispersion is much narrower. As shown in FIG. 1, as a result, the yarn guide means (7*a*, 7*b*, 7*c*, 7*d*) from their working position to the assembly point (A), are arranged before the first feeding means (2*b*), which has the following drawbacks:

- the various means (7*a*, 7*b*, 7*c*, 7*d*), and drive member (5) are installed in the immediate vicinity of the upstream yarn treatment unit;
- the guide members are subjected to high tensions, generating severe requirements as regards reliability;
- the yarn tension, after assembly, is equal to the sum of the tensions of each yarn, so that the feeding and spooling means on the assembled yarns must be dimensioned to withstand this total tension;

the yarns follow a long route with several corners under high tension which, by internal friction on the guide members, causes deterioration and affects the quality of the yarns;

the difficulty, indeed impossibility, of assembling individual yarns having different characteristics (count, yarn type, number or direction of plies, etc.), due to the differences in tension resulting from these differences in characteristics.

SUMMARY OF THE INVENTION

It is the object of the invention to remedy these drawbacks, in a simple, safe, effective and efficient manner, and to solve the problem posed of obtaining perfect control of the yarn assembly process.

To solve such a problem, a device has been designed and developed for managing the assemblies of yarns in textile machines for processing said yarns comprising yarn upstream treatment or transformation units, first yarn feeding and advance means, and feeding and/or spooling means via a thread guide.

According to the invention, to solve the problem posed, the device comprises members suitable for producing an assembly of a plurality of yarns mounted in combination with a plurality of first feeding and advance means which are each controlled by an individual motor, said assembly members being placed between said first feeding means and one of the feeding and/or spooling means suitable for controlling the speed of travel of the joined yarns.

Regardless of the drive means of the feeding and spooling means of the thread guides, separately or synchronized, each individual motor of the first feeding and advance means is subjected to a speed variator.

Based on this underlying concept:

either the feeding and spooling means and the thread guides are each driven by a collective motor;

or the feeding and spooling means and the thread guides are each driven by an individual motor.

According to another embodiment, the thread guides are driven by an individual motor, the feeding and spooling means and the first feeding and advance means being driven in synchronism by the same motor. In this embodiment, the speed ratio between the two means is determined by a system of pulleys.

An improvement to the invention consists in measuring the tension of each yarn by placing a sensor between the first yarn feeding and advance means and the assembly point, and by transmitting these tensions to a computer which controls the variators.

In the case in which the first yarn feeding and advance means have no synchronization link with the feeding and/or spooling members, the computer orders speed adjustments of the first feeding means to adjust the yarn tension measured, to a preprogrammed setpoint.

In the case in which the thread guides are driven by an individual motor, while the first feeding and advance means and the feeding and spooling means are driven in synchronism by the same motor, the computer takes as reference the yarn tension corresponding to the position to which the yarns are pulled, and orders speed adjustments of the first feeding members of the other positions, for example, to equalize the tensions.

Considering the basic features of the invention, it has appeared that the means and arrangements claimed have an advantageous application for producing a yarn, resulting from the assembly by twisting, cabling or covering of several basic yarns composed of a plurality of elementary yarns, some of which undergo a prior transformation operation before being assembled and receiving a new transformation step, at least one of the elementary yarns being different or undergoing a different transformation from the others.

It appears that the development of new textile materials, gives rise to the increasing consideration of novel fabrication methods for obtaining yarns resulting from the combination by assembly of increasingly diversified yarns. This is the case in particular of yarns for technical use, as in the following nonlimiting examples:

for the production of cords, straps, technical fabrics for special uses and having specific mechanical or physical properties of toughness, tensile strength, elasticity, and elongation under load, etc.;

for the production of fabrics, belts, carpeting, textile coatings, having particular aesthetic, mechanical or physical properties;

for the production of textile reinforcements for composites such as elastomers, such as for reinforcing tires, corrugated belts, etc., said yarns intended to be individually inserted, in layers, or employed in the form, for example, of fabrics, and requiring specific mechanical or physical properties of toughness, tensile strength, elasticity, elongation under load, etc.

The invention relates in particular to methods in which the prior transformation operations on the elementary yarn or yarns are methods of single twisting, two-for-one twisting, cabling or covering, etc.

Certain technical features of the yarns such as tensile strength, elasticity, elongation curve under load, fatigue strength, etc., are obtained by combining a plurality of yarns, each subjected to individual treatment, then assembled by perfectly controlled methods. The elementary yarns may be identical or different, and/or undergo identical or different transformations. Depending on the actual application, the methods may be designed to obtain an equi-length and/or equi-tension assembly. In other cases, the assembly method may consist, on the contrary, in assembling yarns having different elongation or tension levels.

In the following discussion, the term "hybrid yarn" is used to denote such yarns resulting from the assembly by twisting or cabling of yarns of different types, having undergone a different treatment or fed under different tensions.

Mention can be made, as a nonlimiting example, of U.S. Pat. No. 6,799,618, which relates to hybrid yarns resulting from the assembly of a plurality of elementary yarns which differ in their type and their prior treatment.

According to the prior art, hybrid yarns, composed of a plurality of elementary yarns which differ in their type and in their prior treatment, like those discussed as examples in the abovementioned patent, are usually produced in two steps. Each elementary yarn is transformed separately in a first step, for example on two-for-one twisting machines, and is individually received on an intermediate bobbin. The intermediate bobbins are then picked up on a creel feeding a machine which combines the assembly phase and the final treatment, such as a method by twisting the assembled yarns. This final treatment is usually carried out by a single twisting method.

This sequencing mode has the following drawbacks:

it imposes the need for at least two types of machines (for example, a two-for-one twisting machine for the first step, an assembly and single twisting machine for the second step);

it requires the management, storage and handling of several batches of intermediate bobbins;

the second assembly step is usually carried out in single twisting, which is a method producing at low speed, for example, on a ring frame, which uses rotating bobbins, with limited weight, and hence requiring frequent clearings. This second step has a relatively low productivity.

It therefore appeared important to propose means for increasing the possibilities of combining different individual yarns and controlling the assembly process, while offering great simplicity of application and better productivity.

The problem that the invention proposes to solve is to obtain a means for producing a hybrid yarn, resulting from the assembly by twisting, cabling or covering of a plurality of basic yarns, these basic yarns being identical or different, and being themselves treated by identical or different twisting or cabling methods. One object of the invention is to perfectly control the speed and/or tension of the yarns at the assembly point (said speeds and/or tensions being equal or different).

This results in a method according to which at least one of the basic yarns is different from the others and/or undergoes a different first transformation from the others;

the prior transformation is carried out in parallel in the same machine consisting of a juxtaposition of independent transformation means equipped with control means and being individually adjustable;

an adjustment of the tension of each yarn, in particular a slackening from the tension resulting from the first transformation to the tension at an assembly point, is carried out on feeding devices equipped with adjusting means and control systems which can be adjusted individually so that the tension at the assembly point is adjusted individually;

the yarns are routed by guide means to the assembly point where they are joined and arranged in parallel;

a bobbin receives the yarns thereby assembled in a device itself constituting, or being associated with, positive feeding means, that is, operating without slippage with respect to the yarn, and able to control the speed of movement of the joined yarns;

The yarn bobbin thus formed is placed on a spindle of a twisting machine according to a second two-for-one twisting, cabling or covering treatment, in which the yarns are joined together by twisting the assembled yarns on themselves, by winding the assembled yarns around another yarn, or by winding another yarn around the assembled yarns.

Depending on the type of hybrid yarn to be produced, the treatment of the receiving bobbin takes place with different means.

The sequencing of these steps may, optionally, be supplemented by adding other supplementary operations, which may be carried out in parallel or be inserted between the abovementioned operations, without altering the sequencing thereof.

According to one embodiment, at least one of the basic yarns has a low elongation capacity under load, preferably combined with a high toughness, and of which at least one other elementary yarn has a higher elasticity and/or elongation capacity under load, the basic yarns being twisted separately to the different plies, then assembled under equal or different tensions, and twisted together.

BRIEF DESCRIPTION OF THE DRAWING FIGURES

The invention is described in greater detail below with reference to the figures in the drawings appended hereto in which.

DETAILED DESCRIPTION

For a better understanding of the rest of the specification, the same numerals are used for the various embodiments of the invention.

In a manner perfectly known to a person skilled in the art, the transformation machine comprises a plurality of working positions. Each position comprises an upstream yarn treatment unit consisting, for example, of two-for-one twisting or cabling spindles (11*a*, 11*b*, 11*c*, 11*d*, . . . ), first feeding and advance means (2*a*, 2*b*, 2*c*, 2*d*, . . . ) of the yarn (1*z*, 1*b*, 1*c*, 1*d*, . . . ) and feeding and/or spooling means (3*a*, 3*b*, 3*c*, 3*d*, . . . ) via a thread guide (6*a*, 6*b*, 6*c*, 6*d*, . . . ).

According to the invention, the device comprises members (7*a*, 7*b*, 7*c*, 7*d*) suitable for preparing an assembly (A) of a plurality of yarns, these members being mounted in combination with a plurality of the first feeding and advance means (2*a*, 2*b*, 2*c*, . . . ).

Importantly, according to the invention, each of the first feeding and advance means (2*a*, 2*b*, 2*c*, 2*d*, . . . ) are controlled by an individual motor (8*a*, 8*b*, 8*c*, 8*d*, . . . ). The assembly members (7*a*, 7*b*, 7*c*, 7*d*, . . . ) are placed between the first feeding and advance means (2*a*, 2*b*, 2*c*, . . . ), and one of the feeding and spooling means (3*b*) suitable for controlling the travel speed of the joined yarns. The assembly members (7*a*, 7*b*, 7*c*, 7*d*, . . . ) are therefore placed downstream of the first feeding and advance means (2*a*, 2*b*, 2*c*, . . . ) and upstream of the feeding and spooling means (3*a*, 3*b*, 3*c*, . . . ).

It has been observed that the feeding and/or spooling means (3*a*, 3*c*) and their corresponding thread guides (6*a*, 6*c*) are, in the particular case of the assembly mentioned as an example, unused, because their respective yarns are diverted toward the feeding means (3*b*) and its corresponding thread guide (6*b*).

Advantageously, regardless of the embodiment (FIG. 2, FIG. 3, FIG. 4), each individual motor (8*a*, 8*b*, 8*c*, 8*d*, . . . ) of the first feeding and advance means (2*a*, 2*b*, 2*c*, 2*d*, . . . ), is subjected to a variator (15*a*, 15*b*, 15*c*, . . . ).

Figure 1:
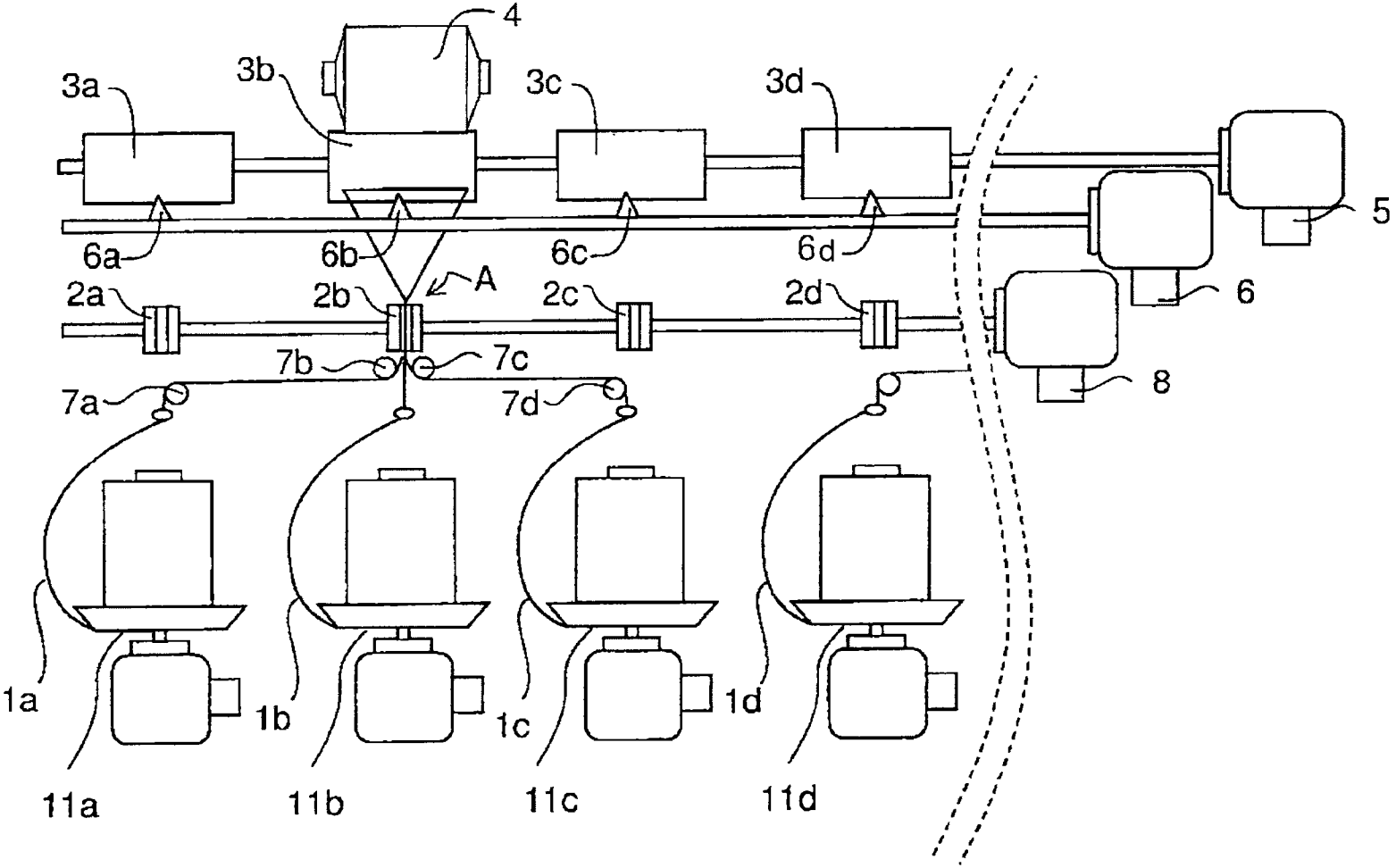
FIG 1 PRIOR ART
FIG. 1 is a schematic view of a transformation machine equipped with yarn assembly members according to the prior art.
Figure 2:
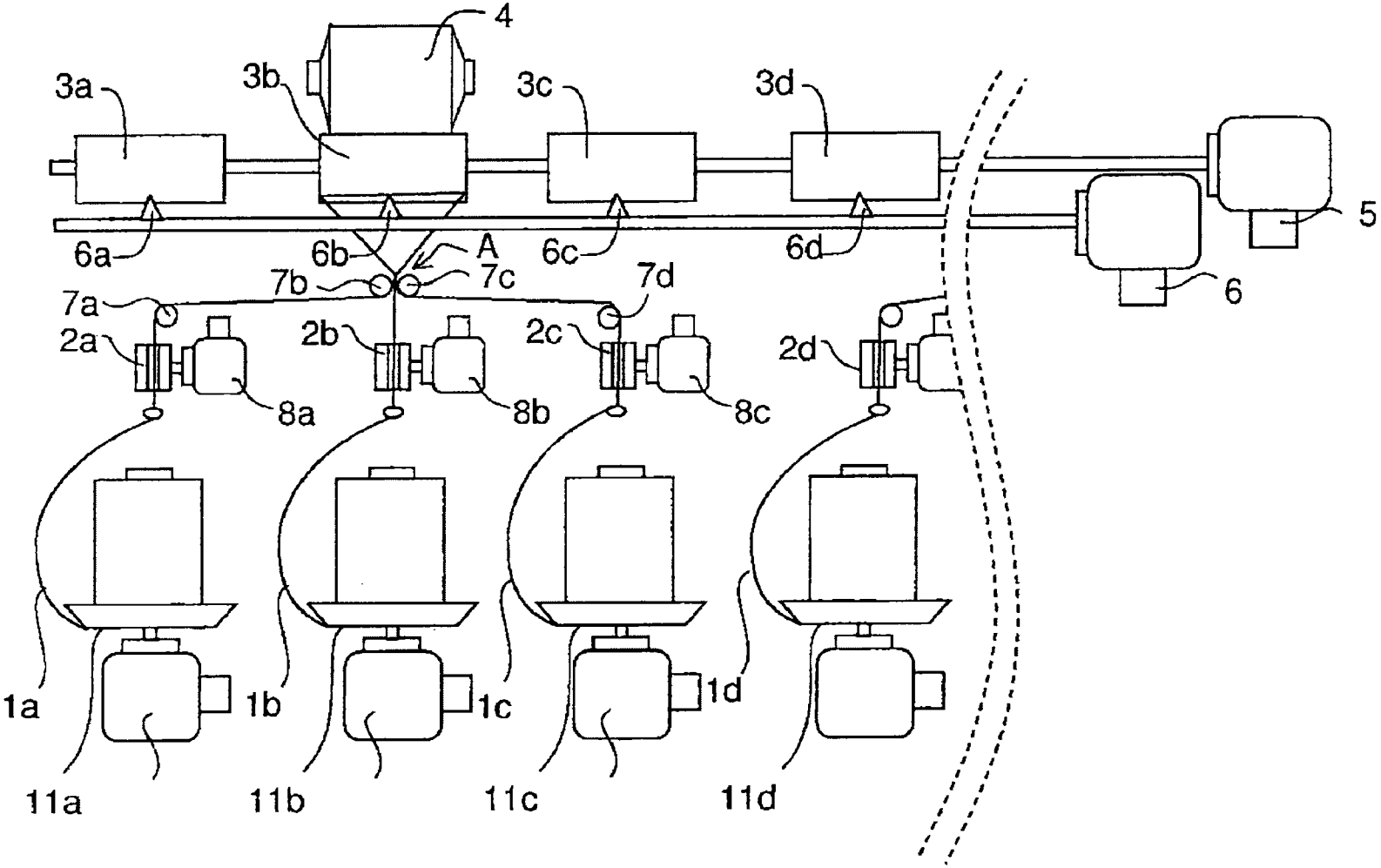
FIG. 2 shows a machine according to the one shown in FIG. 1, equipped with the yarn management and assembly device according to the invention and in an embodiment in which the feeding and spooling means and the thread guides are each driven by a collective motor.

In the embodiment shown in FIG. 2, the feeding and spooling means (3*a*, 3*b*, 3*c*, 3*d*, . . . ) are driven by a common drive member (5). The thread guides (6*a*, 6*b*, 6*c*, 6*d*, . . . ) are driven by a common drive member (6).

Figure 3:
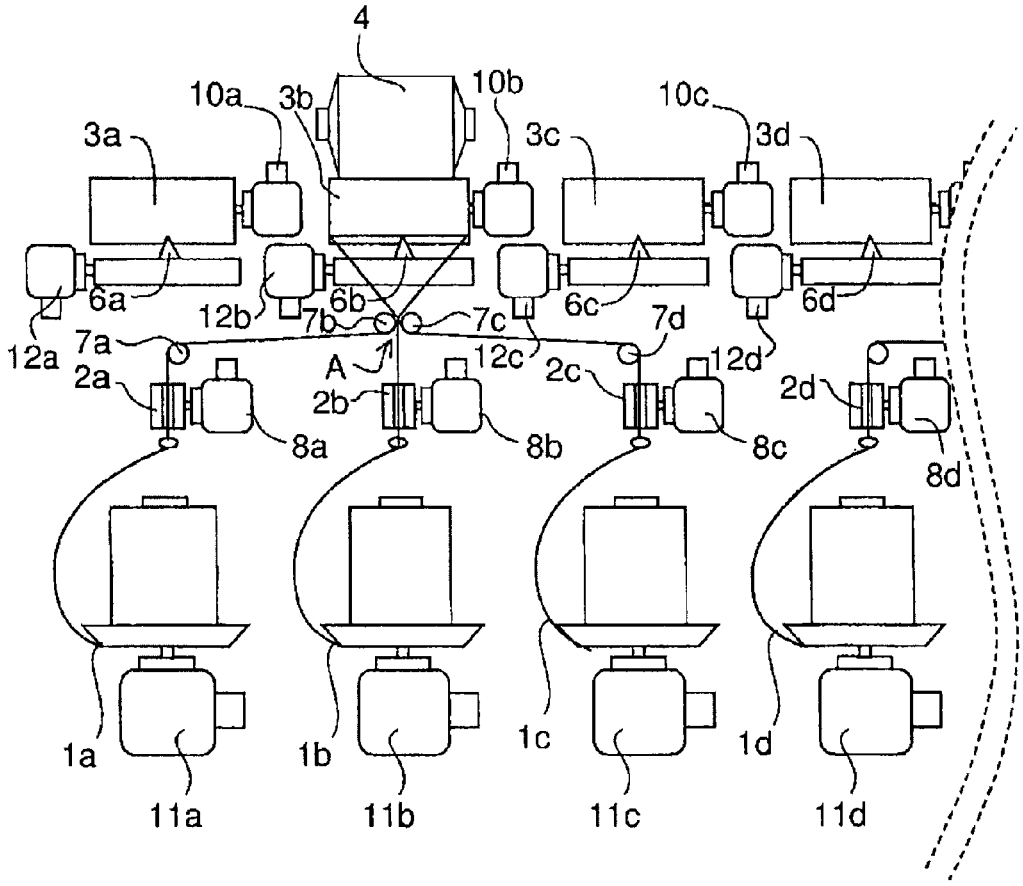
FIG. 3 is a view similar to FIG. 2 in which the feeding and spooling means and the thread guides are each driven by an individual motor.

In the embodiment shown in FIG. 3, the feeding and spooling means (3*a*, 3*b*, 3*c*, 3*d*, . . . ) are each driven by an individual drive member (10*a*, 10*b*, 10*c*, . . . ). The same applies to the thread guides (6*a*, 6*b*, 6*c*, 6*d*, . . . ) which are each driven by an individual motor (12*a*, 12*b*, 12*c*, 12*d*, . . . ).

Figure 4:
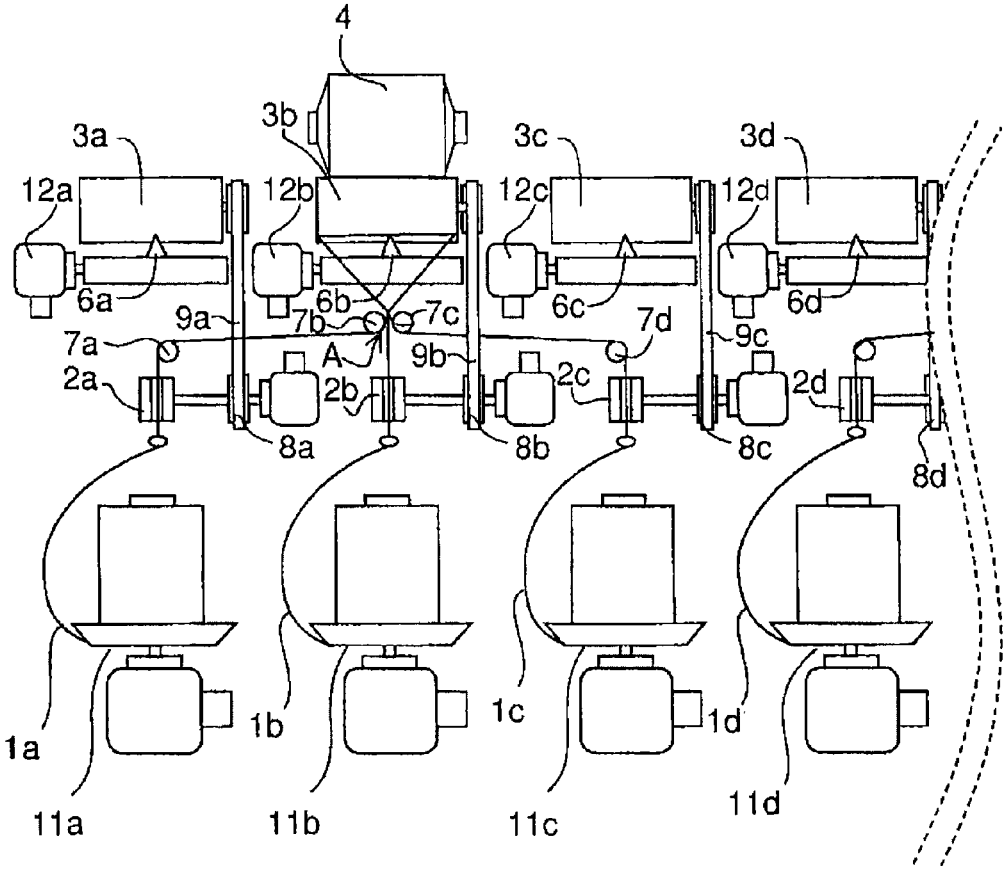
FIG. 4 is a view corresponding to FIG. 3 in which the thread guides are driven by an individual motor, while the feeding and spooling means, and the first feeding and advanced means are driven in synchronism by the same motor.
Figure 5:
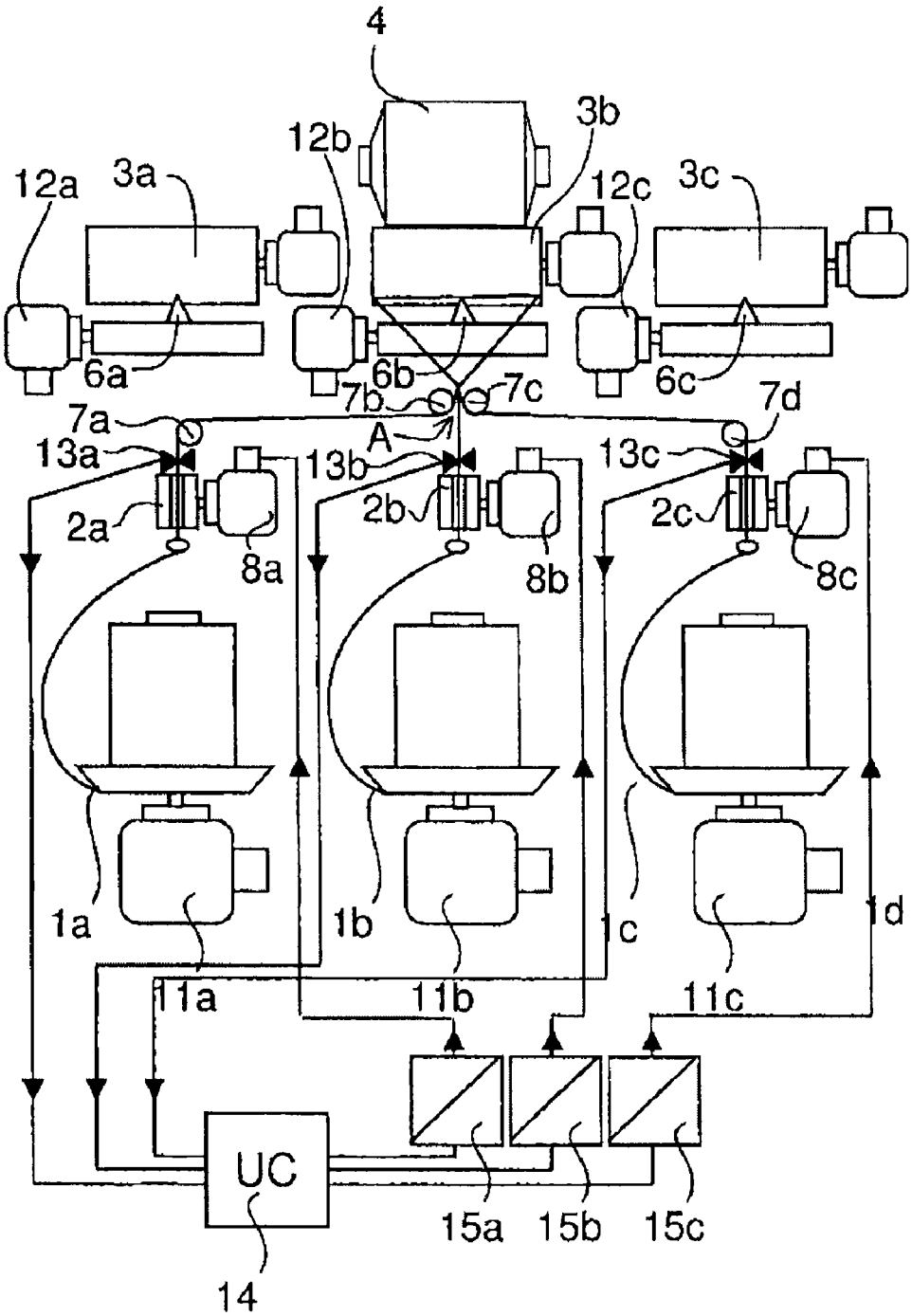
FIG. 5 shows the application and use of a computer and a yarn tension sensor, applied to the embodiment shown in FIG. 3, with the observation that this application may obviously relate to the embodiments shown in FIGS. 2, 3 and 4.

In the embodiment shown in FIG. 4, the feeding and spooling means (3*a*, 3*b*, 3*c*, 3*d*, . . . ) and the first feeding and advance means (2*a*, 2*b*, 2*c*, 2*d*, . . . ) are driven in synchronism by the same motor (8*a*, 8*b*, 8*c*, 8*d*, . . . ). The speed ratio between the means (2*a*, 3*a*), (2*b*, 3*b*), (2*c*, 3*c*), (2*d*, 3*d*), is fixed, for example, by a ratio of pulleys (9*a*, 9*b*, 9*c*).

The variators (15*a*, 15*b*, 15*c*, . . . ) controlling the first feeding means are associated with speed adjusting means in the form, for example, of local control accessible by an operator.

Alternatively, the variators (15*a*, 15*b*, 15*c*, . . . ) are controlled by a computer (14) delivering a setpoint to each variator, said setpoint being, for example, programmed by an operator.

As indicated, the device has a particularly advantageous application, for the production of a hybrid yarn resulting from the assembly by twisting, cabling or covering of a plurality of basic yarns (1*a*, 1*b*, 1*c*, . . . ).

It may be recalled, in a manner perfectly known to a person skilled in the art, that the transformation process comprises three main operations:

- a first transformation (Pa, Pb, Pc, . . . ) or all or part of the elementary yarns (Fa, Fb, Fc, . . . ) by a twisting, cabling, covering operation. This operation is carried out on a twisting spindle;
- an assembly, the yarns being joined parallel to one another at point (A);
- a second transformation (S) of the assembled yarns, which is a twisting, cabling or covering operation. This operation is carried out on a twisting spindle.

These operations may, optionally, be preceded upstream, or be supplemented by other steps, intermediate or associated with one or the other of these three operations, such as operations of rewinding, thermofixing, stretching, etc., without this affecting the scope of the present application insofar as the abovementioned three operations are grouped in two steps according to the sequencing mode described.

According to one important aspect of the invention, the means (11*a*, 11*b*, 11*c*, . . . ) serve to carry out the first transformation (Pa, Pb, Pc, . . . ) of the basic yarns (1*a*, 1*b*, 1*c*, . . . ) and are preferably placed adjacently and comprise individual drive means, each individually controlled by systems such as speed variators (16*a*, 16*b*, 16*c*, . . . ). Each means (11*a*, 11*b*, 11*c*, . . . ) is therefore set to carry out a transformation (Pa, Pb, Pc, . . . ) specific to each yarn, which may be different from the others, for example, a twisting of different value or direction. Optionally, some of the yarns (1*a*, 1*b*, 1*c*, . . . ) may not be transformed, or their transformations may be at 0 turns, the yarn no longer receiving a twist, and only the unwinding and/or pretension means of the corresponding transformation means being employed. At the outlet of the transformation means (11*a*, 11*b*, 11*c*, . . . ), each yarn has a tension which depends on its count and on the transformation (e.g. speed, drum diameter, yarn count, etc.).

Each yarn (1*a*, 1*b*, 1*c*, . . . ) passes through first feeding means (2*a*, 2*b*, 2*c*, . . . ) for adjusting its tension and particularly for reducing the yarn tension resulting from the transformation of the yarn (Pa, Pb, Pc . . . ), in the form, for example, of a capstan or a grid type delivery unit, generally known as a "pre-delivery unit" or "pre-feeding" unit. In the rest of the specification, this member is designated by the name of "first feeding means". For example, to produce a slackening, this member permits a slippage of the yarn and turns in overspeed with regard to the yarn travel.

Importantly, each of the first feeding and advance means (2*a*, 2*b*, 2*c*, . . . ) is provided with means for adjusting its efficiency. This means may, for example, consist in adjusting the winding arc of a delivery unit grid, or the number of turns wound around a capstan. This adjustment can be achieved manually or by actuators. This means for individually adjusting the efficiency of the first feeding means (2*a*, 2*b*, 2*c*, . . . ) may also consist in adjusting the speed of the delivery member, for example, by being controlled by an individual motor (8*a*, 8*b*, 8*c* . . . ), individually controlled by systems such as speed variators (15*a*, 15*b*, 15*c* . . . ).

Each feeding and advance means (2*a*, 2*b*, 2*c* . . . ) is hence set to adjust the specific tension of each yarn to the assembly tension which may be different from the others. At the outlet of the feeding and advance means (2*a*, 2*b*, 2*c* . . . ), the yarn has a tension corresponding to the tension to be obtained at the assembly point (A).

The yarns (2*a*, 2*b*, 2*c* . . . ) are routed to the assembly point (A) by guide members (7*a*, 7*b*, 7*c*, . . . ). The members (7*a*, 7*b*, 7*c*, . . . ) and the point (A) are placed between the first feeding and advance means (2*a*, 2*b*, 2*c* . . . ) and the spooling means (3) suitable for controlling the travel speed of the joined yarns. The yarns (1*a*, 1*b*, 1*c*) joined in parallel, are then drawn by one of the spooling means which forms an intermediate bobbin (4).

The bobbin (4) of unitary yarns (1*a*, 1*b*, 1*c* . . . ) having received the first treatment (Pa, Pb, Pc . . . ) is then taken up in a second machine to receive the second treatment (S). The assembled yarn is twisted in the spindle (17), passes through a feeding member (18) and is then spooled by the spooling means (19), forming the final bobbin (20).

Figure 6:
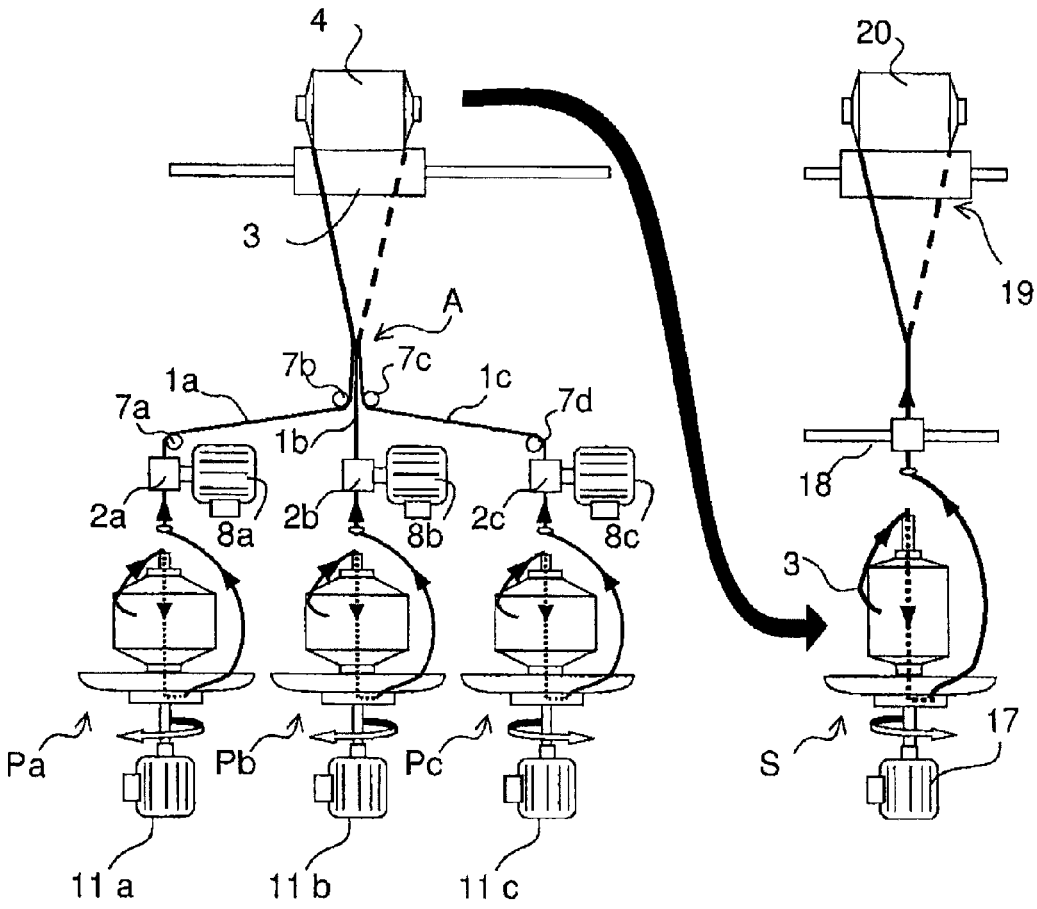
FIG. 6 is a schematic view of a method for producing a hybrid yarn, shown here as an example of three-end twisting, by the inventive method, in which the prior twisting of the elementary yarns and the assembly is carried out with independent two-for-one twisting positions, and the final twisting of the assembled yarn is carried out by the two-for-one twisting method.

Advantageously, regardless of the embodiment (FIG. 6 et seq), each individual motor of the first transformation means (11*a*, 11*b*, 11*c* . . . ) is subjected to a variator (16*a*, 16*b*, 16*c* . . . ) and each individual feeding motor (8*a*, 8*b*, 8*c* . . . ) and advance motor (2*a*, 2*b*, 2*c* . . . ) is subjected to a variator (15*a*, 15*b*, 15*c* . . . ). These variators (15*a*, 15*b*, 15*c* . . . 16*a*, 16*b*, 16*c* . . . ) are associated with speed adjusting means in the form, for example, of a setpoint or a local control accessible to an operator.

Alternatively, the variators (15*a*, 15*b*, 15*c* . . . 16*a*, 16*b*, 16*c* . . . ) are controlled by a computer (14) delivering a setpoint to each variator, said setpoint being, for example, programmable by an operator.

Figure 7:
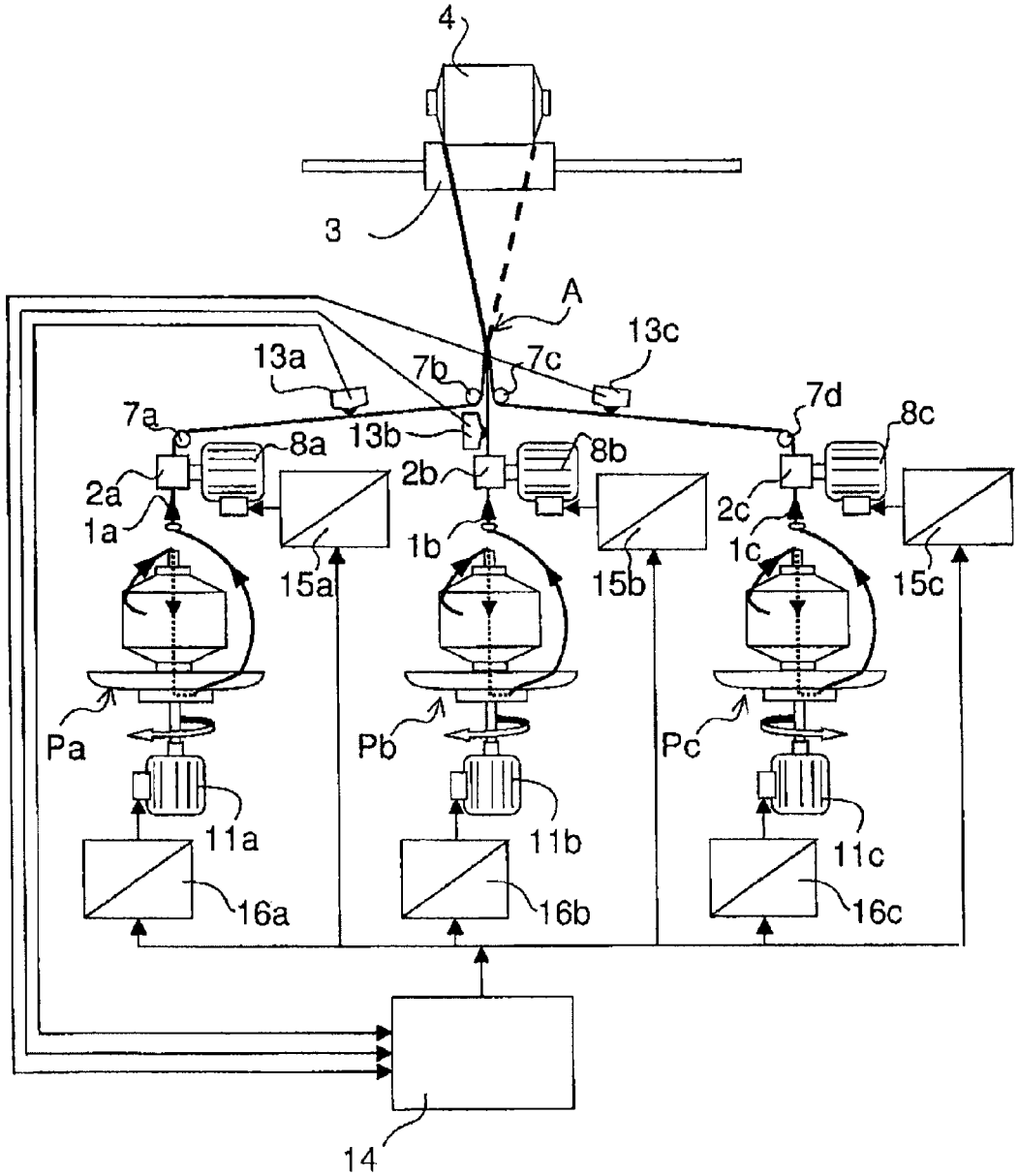
FIG. 7 is a schematic view of the assembly tension control means.

An improvement to the invention, shown in FIG. 7, consists in placing the means for measuring the tension of each yarn, in the form, for example, of sensors (13*a*, 13*b*, 13*c*, . . . ) downstream of the first feeding and advance means (2*a*, 2*b*, 2*c*, . . . ) and upstream of the yarn assembly point (A). The tension indication of each yarn is sent to a computer (14) which transmits the setpoints to the variators (15*a*, 15*b*, 15*c* . . . ) controlling the motors (8*a*, 8*b*, 8*c*, . . . ) of the first feeding and advance means (2*a*, 2*b*, 2*c* . . . ).

The computer (14), in the form for example of a central processor, permanently adjusts the speed of the first feeding means (2*a*, 2*b*, 2*c* . . . ) to guarantee perfect compliance with the yarn tension demanded by the method at the assembly point (A) in order to offset any drift in the settings over time.

The tensions required by the assembly method may be equal tensions between each yarn or different tensions from one yarn to another.

According to the invention, it is therefore possible to prepare assemblies of yarns (1*a*, 1*b*, 1*c*, . . . ) having different characteristics, each yarn being led to the assembly point (A) under a predefined tension controlled by the system. This result is particularly advantageous for assembling yarns having different elasticities.

It should be noted that means for measuring the tension of each yarn may be replaced and/or supplemented by means suitable for measuring the travel speed of the yarn immediately before the assembly point (A).

Figure 8:
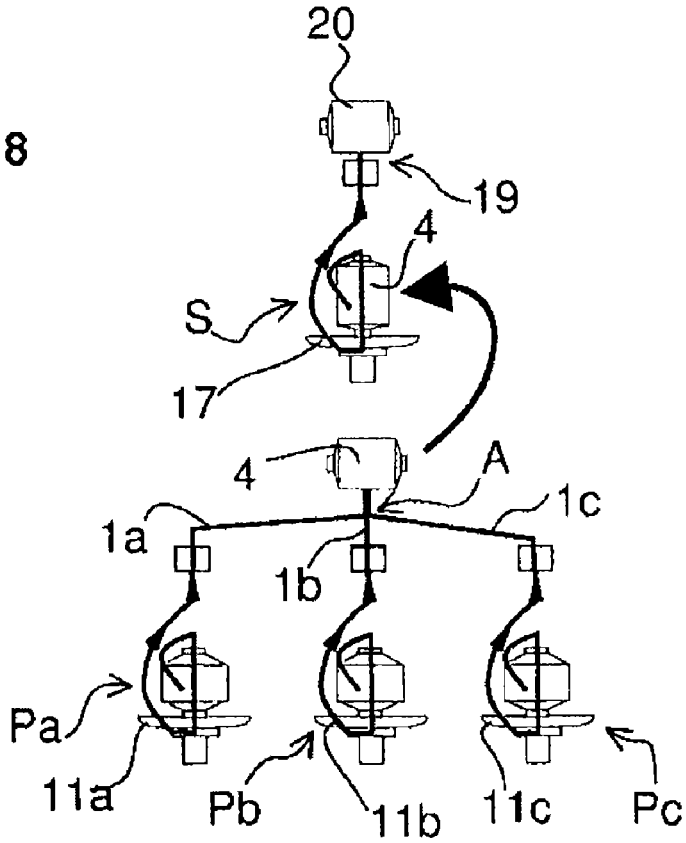
FIG. 8 is a very schematic view showing the two-step method of the invention, as shown in greater detail in FIG. 6.
Figure 9:
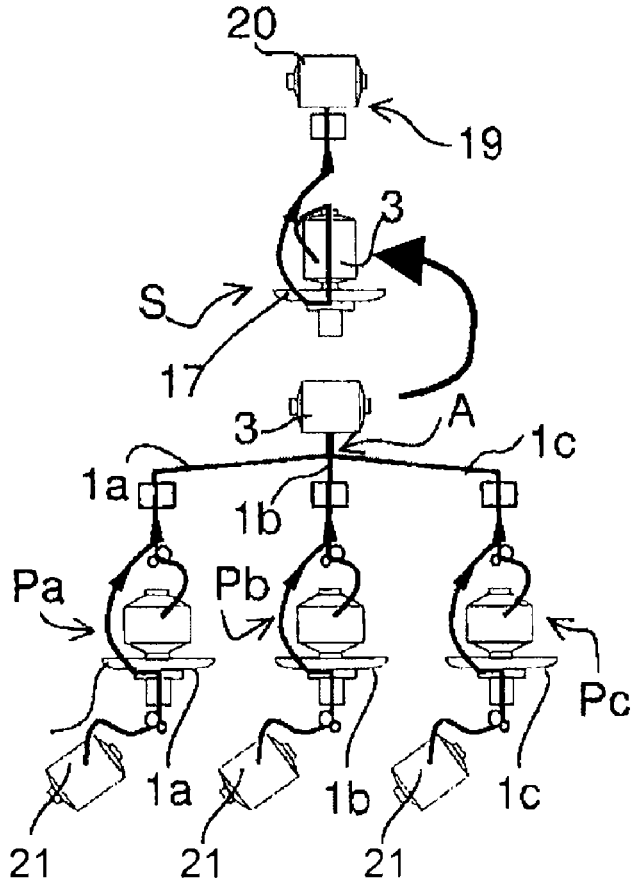
FIG. 9 is a very schematic view of a complete two-step method in which the second step is carried out by two-for-one twisting of three assembled yarns, each of these assembled yarns consisting of pairs assembled by a direct cabling method.

The inventive method, illustrated in FIGS. 8 and 9, is particularly designed for producing a hybrid yarn for reinforcing tires or composites. This method consists in using at least two basic yarns (1*a*, 1*b*, 1*c*, . . . ) of which at least one is different from the others. At least one of the basic yarns has a low elongation capacity under load, and at least one other elementary yarn has a higher elasticity and/or elongation capacity. The basic yarns are twisted separately to different plies, then assembled under equal or different tensions, and twisted together.

The production process according to the invention comprises the following steps:

all or part of the elementary yarns are twisted simultaneously and in parallel by a two-for-one twisting or direct cabling method (Pa, Pb, Pc . . . ), on spindles (11*a*, 11*b*, 11*c* . . . ) preferably adjacent of a twisting machine;

- each yarn is sent to a first delivery member (2*a*, 2*b*, 2*c*, . . . ) of which the efficiency is adjustable independently from the others, to adjust its tension to the assembly tension;
- the yarns are guided by guide devices (7*a*, 7*b*, 7*c*, . . . ) to the assembly point (A) where they are joined in an essentially parallel arrangement;
- the yarns thereby assembled are spooled to form an intermediate bobbin (4), the yarns being driven without slippage;
- the intermediate bobbin of assembled yarns (4) thus formed is placed on a two-for-one twisting spindle (17) and the assembled yarns are twisted by the conventional two-for-one twisting method (S), the assembled yarns being joined together by winding on themselves.

According to the invention, some of the yarns (1*a*, 1*b*, 1*c*, . . . ) may not be transformed or twisted, only the unwinding and pretension means of the corresponding transformation means being used.

Figure 12:
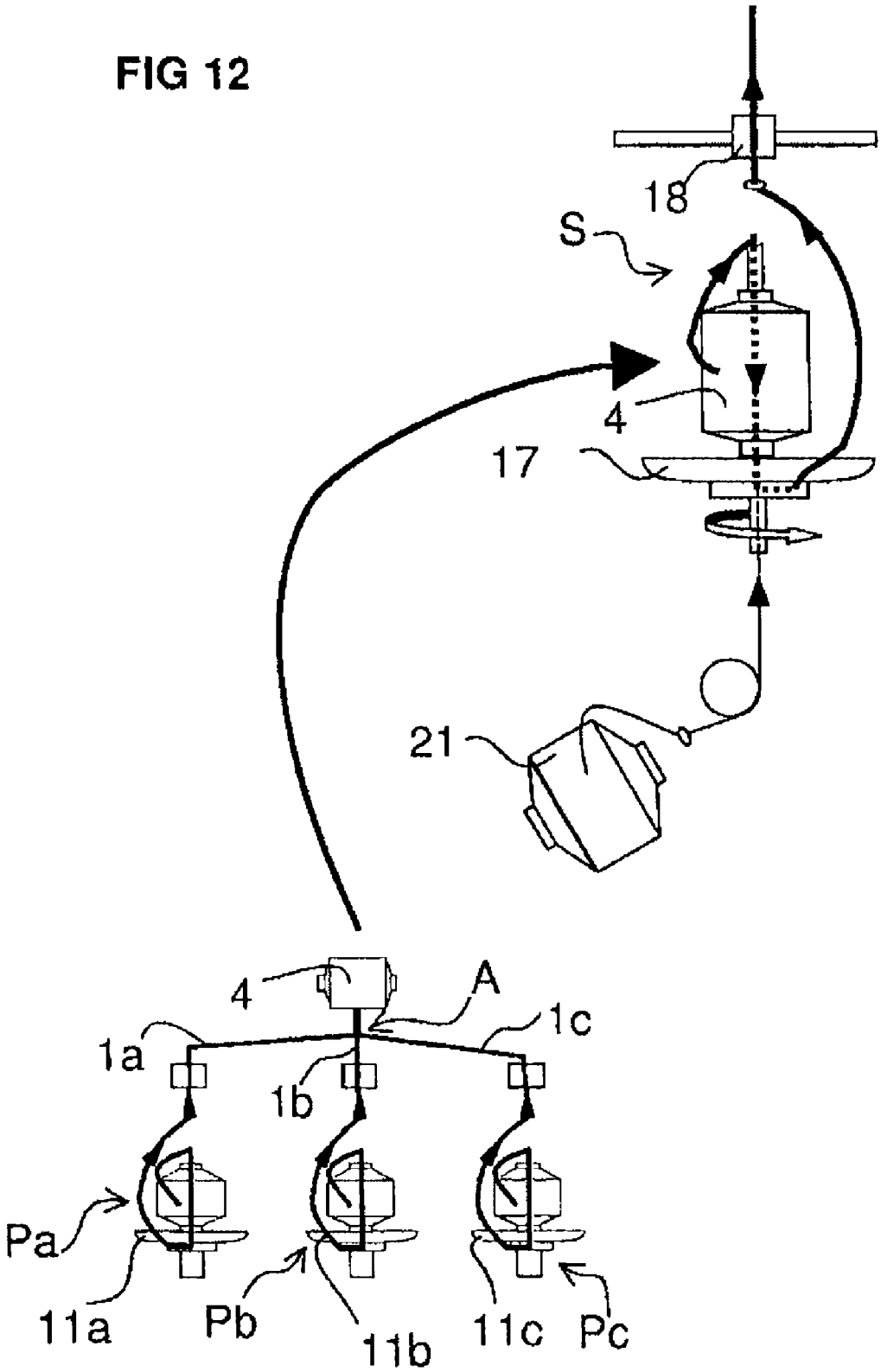
FIG. 12 is a schematic view of an alternative of the inventive method in which an auxiliary yarn is added in the final two-for-one twisting step.

According to the embodiment of the invention shown in FIG. 12, an auxiliary yarn (21) may be introduced into the assembly.

According to each case, it may be:

- assembled without prior transformation at the assembly point A, its tension being optionally adjusted by a tensioner or any similar auxiliary delivery member;
- introduced on the two-for-one twisting spindle (17) via the hollow shaft, to join the yarns assembled in the first step at the outlet of the spindle (17), so that the auxiliary yarn is not twisted but is joined by winding around the assembled yarns which are twisted together in two-for-one twisting mode (two twist per turn of the spindle).

The auxiliary yarn (21) may be a yarn having an auxiliary function such as, for example, an antistatic or gas absorbing yarn. It may, itself, be a yarn formed by the assembly of a plurality of yarns, and/or may have undergone prior treatments.

Figure 10:
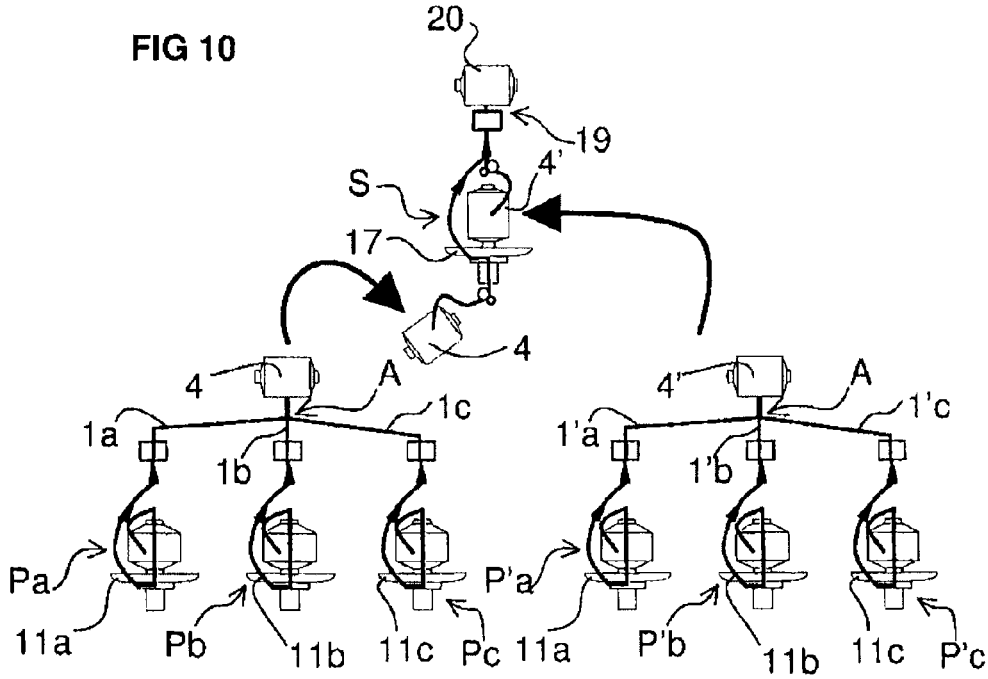
FIG. 10 is a very schematic view of a complete two-for-one method in which the second step is carried out by direct cabling of two assembled yarns, each of these assembled yarns consisting of three yarns twisted by two-for-one twisting.
Figure 11:
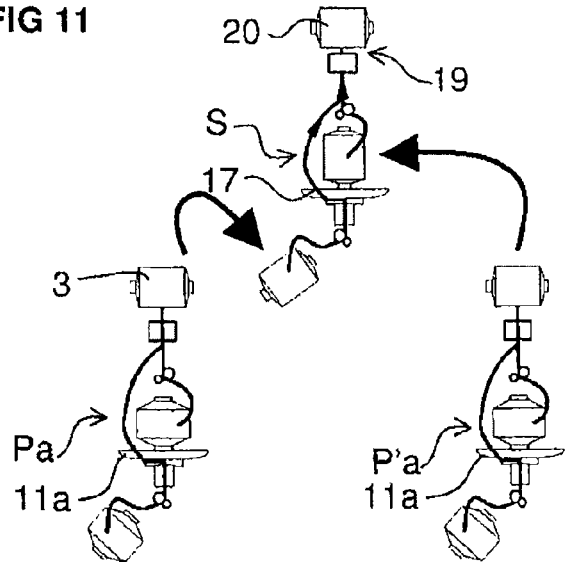
FIG. 11 is a very schematic view of a complete two-step method in which the second step is carried out by direct twisting of two assembled yarns, each of these two assembled yarns consisting of two yarns assembled by a direct cabling method.

The inventive method, illustrated by FIGS. 10 and 11, is particularly intended for producing a complex hybrid yarn for reinforcing tires or composites. This second embodiment of the inventive method is characterized in that it uses at least two staple yarns of which at least one of the elementary yarns has a low elongation capacity, preferably combined with high toughness and of which at least one other elementary yarn has a higher elasticity and/or elongation capacity, the staple yarns being twisted separately to different levels, and then assembled under equal or different tensions, and joined together by winding with another yarn.

The method comprises the same steps as that described previously with the sole difference that the intermediate bobbin (4) is placed on a hollow spindle (10) for twisting or covering (17), the assembled yarns are joined by associating them with another yarn (4'), by a twisting or covering method.

According to this second embodiment, the other yarn (4') which is associated with the first yarn (4) in the final step is different from the first assembled yarn (4), either in its composition of yarns (1'*a*, 1'*b*, 1'*c*), or in the treatment undergone (P'a, P'b, P'c, . . . ), the two yarns (4) and (4') being joined by the process known as "direct cabling".

According to this second embodiment, said assembled yarn (4) constitutes the core, and the yarn (4') associated in the last step is a binding yarn surrounding the core yarn by a covering method.

The associated yarn (4') may be a yarn having an auxiliary function such as, for example, an antistatic or gas absorbing yarn. It may itself be a yarn formed by the assembly of a plurality of yarns, and/or have undergone prior treatments.

According to the invention, in the first transformation (Pa, Pb, Pc . . . ) the speed of each spindle (11*a*, 11*b*, 11*c* . . . ) twisting the basic yarns (1*a*, 1*b*, 1*c*, . . . ) is set so that the yarn(s) with the lowest elongation capacity receive(s) a higher number of twists per meter than the high-elasticity yarn(s).

According to the invention, in the first transformation (Pa, Pb, Pc . . . ), the spindles (11*a*, 11*b*, 11*c* . . . ), using the lower elongation capacity yarn(s) rotate:

- either in the same direction as that of the spindles twisting the high-elasticity yarn(s);
- or in the reverse direction to that of the spindles twisting the high-elasticity yarn(s), for example, the lower elongation capacity yarn(s) are twisted in "Z" and the higher elasticity yarn(s) are twisted in "S".

According to the invention, in the second transformation (S), the final twisting of the assembled yarns takes place in the reverse direction to the twisting of the yarn(s) having the lowest elongation capacity.

According to the invention, in the second transformation (S), the number of plies per meter during the final twisting is less than or equal to the number of plies per given meter during the first transformation of the yarn(s) having the lowest elongation capacity.

A first example of the inventive method is given below, applied to the production of a yarn for the production of belts, consisting of two elementary yarns of BCF 1240 dtex polypropylene, twisted at 180 turns per meter in Z, and a CF 600 dtex polypropylene yarn twisted at 130 turns/meter in S. The three yarns are joined and twisted together at 160 turns/meter in Z.

The two BCF polypropylene yarns (1*a*, 1*b*) are twisted in the spindles (11*a*, 11*b*) set to rotate at 5500 r/min in Z, and the polypropylene CF yarn (1*c*) is twisted in the spindle (11*c*) set to rotate at 3970 r/min in S.

The spooling system (3) winds the assembled yarns on a spindle (4) at a spooling speed of 61.1 m/min, without slippage.

The bobbin (4) is taken up on a two-for-one twisting spindle (17) rotating at 3500 r/min, with a feeding speed of 43.7 m/min, without slippage.

A second example of the inventive method is given below, applied to the production of a yarn for reinforcing tires, consisting of two elementary yarns of aramide 1100 dtex, twisted at 510 turns per meter in Z, and a nylon 940 dtex yarn twisted at 350 turns/meter in Z. The three yarns are assembled and twisted together at 350 turns/meter in S.

The two aramide yarns (1*a*, 1*b*) are twisted on the spindles (11*a*, 11*b*), set to rotate at 7000 r/min in Z, and the nylon yarn (1*c*) is twisted on the spindle (11*c*) set to rotate at 4800 r/min in Z.

The spooling system (3) winds the assembled yarns on a bobbin (4) at a spooling speed of 27.45 m/min, without slippage.

The bobbin (4) is taken up on a two-for-one twisting spindle (17) rotating at 5250 r/min, with a feeding speed of 30 m/min, without slippage.

The preceding examples are given to illustrate the implementation of the inventive method and are nonlimiting.

The advantages clearly appear from the specification, and the following are particularly emphasized and recalled:

- The means for guiding the yarn toward the assembly point are installed in a zone distant from the spindle and hence more accessible to the operator.
- The guide members (casters, guides) are subject to low tensions since they are located after the first feeding.
- The pre-delivery members only have to withstand the tension of one yarn.
- The yarns follow a long route and have several corners under low tension, thereby preventing the deterioration of their quality (tensile strength, risk of broken strands, etc).
- It is possible to prepare yarn assemblies, each yarn being of a different type or count and receiving a different first treatment (in twisting direction or parameter number of plies) from the other yarns.
- After this first transformation, the yarns can be led to the assembly point under predefined tensions or speeds different from the others.
- The transfer from the first step to the second is provided by a single intermediate bobbin which contains the preassembled and preconditioned yarns in order to obtain the desired equilibrium of length and tension.
- The second transformation can be carried out by the two-for-one twisting or direct twisting method, which procures optimal productivity.
- A very wide variety of assembly configurations can be considered, with the joining of an unlimited number of yarns.

The invention claimed is:

1. A method for producing a yarn, resulting from assembly by twisting, cabling or covering of a plurality of basic yarns, comprising:

subjecting at least one yarn of a plurality of basic yarns to a prior transformation;

at least one yarn of the plurality of basic yarns being different from another yarn of the plurality of basic yarns and/or undergoing a first transformation different from the prior transformation;

the prior transformation being carried out in parallel in the same machine by independent transformation means equipped with control means and being individually adjustable;

carrying out on feeding devices a reduction in tension of each yarn of the plurality of basic yarns at an assembly point relative to an amount of tension resulting from the prior transformation, is;

the yarns routed by guide means to the assembly point where the yarns are assembled and arranged in parallel;

a bobbin receiving the assembled yarns in a device having, or being associated with, positive feeding means operating without slippage with respect to the yarn, and configured to control speed of movement of the assembled yarns; and placing the bobbin with the assembled yarns on a spindle of a twisting machine and the bobbin receiving a second two-for-one twisting, cabling or covering treatment, in which the assembled yarns are joined together by twisting the assembled yarns on themselves, by winding the assembled yarns around another yarn, or by winding another yarn around the assembled yarns.

2. A method for producing a hybrid yarn, resulting from assembly by twisting, cabling or covering of a plurality of basic yarns, comprising:

subjecting at least one yarn of a plurality of basic yarns to a prior transformation:

at least one yarn of the plurality of basic yarns having a low elongation capacity under load, and at least one other yarn of the plurality of basic yarns having a higher elasticity and/or elongation capacity under load, the plurality of basic yarns being twisted separately to the different torsions, then assembled under equal or different tensions, and twisted together;

a first transformation of the basic yarns is carried out in parallel in same machine by independent transformation means equipped with control means and being individually adjustable;

carrying out on feeding devices a reduction in tension of each yarn of the basic yarns at an assembly point relative to an amount of tension resulting from the first transformation;

the yarns are routed by guide means to the assembly point where the yarns are assembled and arranged in parallel;

a bobbin receiving the assembled yarns in a device having, or being associated with, positive feeding means, operating without slippage with respect to the yarn, and configured to control speed of movement of the assembled yarns;

placing the bobbin with assembled yarns in a spindle of a two-for-one twisting machine, the assembled yarns being joined together by twisting on themselves.

3. A method for producing a hybrid yarn, resulting from assembly by twisting, cabling or covering of a plurality of basic yarns, comprising:

subjecting at least one yarn of a plurality of basic yarns to a prior transformation;

at least one of the basic yarns having a low elongation capacity under load, and at least one other yarn of the plurality of basic yarns having a higher elasticity and/or elongation capacity under load, the plurality of basic yarns being twisted separately to different plies, then assembled under equal or different tensions, and twisted together;

a first transformation of all or part of the plurality of basic yarns is carried out in parallel in same machine by independent transformation means equipped with control means and being individually adjustable;

carrying out on feeding devices a reduction in tension of each yarn of the plurality of basic yarns at an assembly point relative to an amount of tension resulting from the first transformation, is carried out the feeding devices equipped with adjusting means and control systems adjustable individually so that the tension at the assembly point is adjusted individually;

the yarns are routed by guide means to the assembly point where they are assembled and arranged in parallel;

a bobbin receiving the assembled yarns in a device having, or being associated with, positive feeding means, operating without slippage with respect to the yarn, and able to control speed of movement of the assembled yarns;

lacing the bobbin with the assembled yarns on a hollow twisting or covering spindle, in which the assembled yarns are joined by combining them with another yarn, by a direct cabling or covering method.

4. The method as claimed in claim 1, wherein the feeding devices comprise adjusting means which can be adjusted individually so that the tension at the assembly point is adjusted individually.

5. The method as claimed in claim 4, wherein the adjusting means of the feeding devices comprise an actuator or a drive unit associated with individual control means.

6. The method as claimed in claim 1, wherein the prior transformation of the basic yarns is a two-for-one twisting or direct cabling operation.

7. The method as claimed in claim 1, wherein the prior transformation is a two-for-one operation for one portion, and a direct cabling operation for another portion of the basic yarns.

8. The method as claimed in claim 1, wherein some of the plurality of yarns do not undergo transformation or the transformation of some of the yarns does not produce twist, the corresponding transformation means being set at "0" turns, the yarns using unwinding or pretension means.

9. A device for preparing assemblies for producing a yarn resulting from assembly of a plurality of basic yarns in textile machines for transforming said yarns, comprising:

upstream treatment or transformation units;

first yarn feeding and advance means each controlled by an individual motor;

feeding and spooling means having a thread guide; and assembly means for producing an assembly of several yarns, mounted in combination with several of the first yarn feeding and advance means, said assembly means, being placed between said first feeding means, and one of the feeding and spooling means being able to control speed of travel of the assembly of yarns, each individual motor, being subjected to a speed variator.

10. The device as claimed in claim 9, wherein each transformation unit is equipped with an individual drive unit, subject to a speed variator which receives a rotational speed and/or direction setpoint independently of adjacent positions.

11. The device as claimed in claim 10, wherein some of the transformation units receive a zero speed setpoint, the yarn being able to use unwinding and/or pretension units.

12. The device as claimed in claim 8, wherein each first feeding and advance means is subjected to an individual device for varying its efficiency by adjusting its speed and/or yarn winding arc on a drive surface, wherein speed adjustment is obtained by an individual drive unit subjected to a speed variator which receives a speed setpoint independently of adjacent positions.

13. The device as claimed in claim 9, wherein each speed variator controlling the independent individual transformation means and/or each speed variator controlling the first independent feeding means, receive an individual speed setpoint from a control system or a computer.

14. The device as claimed in claim 9, wherein a quantity representative of tension of each yarn is measured by a sensor and transmitted to a computer which controls the transformation units and/or the feeding means, and said computer orders adjustments to the speed of the first feeding means to adjust the tension of each yarn with respect to a preprogrammed setpoint.

15. The device as claimed in claim 14, wherein a spooling tension setpoint is programmed in the computer, which orders speed adjustments of the first feeding members to comply with the tension setpoint, said setpoint being the same for each position or different at each position.

16. The device as claimed in claim 9, wherein the feeding and spooling means having the thread guide comprises a plurality of feeding and spooling means having the thread guide, and wherein all of the plurality of feeding and spooling means having the thread guide are driven by a collective motor.

17. The device as claimed in claim 9, wherein the feeding and spooling means having the thread guide comprises a plurality of feeding and spooling means having the thread guide and wherein each of the plurality of feeding and spooling means having the thread guide are driven by an individual motor.

18. The device as claimed in claim 9, wherein each thread guide is driven by an individual motor, the feeding and spooling means and the first feeding and advance means are driven in synchronism by the same motor and speed ratio between the feeding and spooling means and the first feeding and advancing means is determined by a system of pulleys or belts.

19. The device as claimed in claim 18, wherein adjustment of a first position to which the yarns are fed after the assembly point, is determined to adjust feeding speed, other positions being set to adjust output tension of first feeding means with respect to the tension of the first position which is used as a reference.

20. The device as claimed in claim 19, further comprising a computer which uses as a reference the yarn tension corresponding to the first position to which the yarns are fed, and orders speed adjustments of the first feeding members of the other positions, so that the tension of each yarn, other than the one to which the yarns are fed, is adjusted to be equal to the tension used as a reference or to present a programmable difference or proportionality with respect to the tension used as a reference.

* * * * *

UNITED STATES PATENT AND TRADEMARK OFFICE

CERTIFICATE OF CORRECTION

PATENT NO. : 7,802,418 B2
APPLICATION NO. : 11/568043
DATED : September 28, 2010
INVENTOR(S) : Christophe Vega It is certified that error appears in the above-identified patent and that said Letters Patent is hereby corrected as shown below:

Claim 9, at Column 13, Line 56: after -- upstream -- Delete "treatment or"

Signed and Sealed this
Twenty-eighth Day of December, 2010

David J. Kappos

David J. Kappos
*Director of the United States Patent and Trademark Office*